US010406450B2

(12) United States Patent
Howard

(10) Patent No.: US 10,406,450 B2
(45) Date of Patent: Sep. 10, 2019

(54) FIDGET SPINNER TOY HOLDING ADAPTER

(71) Applicant: Nicholas Jeremiah Howard, Walls, MS (US)

(72) Inventor: Nicholas Jeremiah Howard, Walls, MS (US)

( * ) Notice: Subject to any disclaimer, the term of this patent is extended or adjusted under 35 U.S.C. 154(b) by 0 days.

(21) Appl. No.: 15/709,034

(22) Filed: Sep. 19, 2017

(65) Prior Publication Data

US 2019/0083892 A1 Mar. 21, 2019

(51) Int. Cl.

| | |
|---|---|
| ***A63H 33/00*** | (2006.01) |
| ***A63H 27/00*** | (2006.01) |
| ***A63H 17/26*** | (2006.01) |
| ***A63H 17/21*** | (2006.01) |
| ***A63H 17/16*** | (2006.01) |
| ***A63H 1/00*** | (2019.01) |

(52) U.S. Cl.

CPC ..... *A63H 33/00* (2013.01); *A63H 1/00* (2013.01); *A63H 17/16* (2013.01); *A63H 17/21* (2013.01); *A63H 17/264* (2013.01); *A63H 27/02* (2013.01); *A63H 27/12* (2013.01)

(58) Field of Classification Search

CPC ..... A63H 33/00; A63H 33/30; A63H 33/42; A63H 17/16; A63H 17/21; A63H 27/02; A63H 1/00

See application file for complete search history.

(56) References Cited

U.S. PATENT DOCUMENTS

| | | | | |
|---|---|---|---|---|
| 2,765,580 | A * | 10/1956 | Herrschaft | A63H 33/102 403/167 |
| 3,789,562 | A * | 2/1974 | De Chicchis | A63H 33/107 403/106 |
| 7,437,840 | B2 * | 10/2008 | Ratmansky | G09F 3/18 206/0.8 |
| 8,894,337 | B2 * | 11/2014 | Bourget | F16B 1/0071 411/373 |
| 9,062,483 | B1 * | 6/2015 | McGrath | E05D 3/02 |
| 9,950,556 | B1 * | 4/2018 | Laemle | B43K 29/00 |
| 2006/0154556 | A1 * | 7/2006 | Tong | A63H 33/065 446/122 |
| 2012/0177497 | A1 * | 7/2012 | Huang | A63H 27/02 416/204 R |
| 2013/0019380 | A1 * | 1/2013 | Sitt | A42B 1/24 2/209.13 |

* cited by examiner

*Primary Examiner* — Eugene L Kim
*Assistant Examiner* — Alyssa M Hylinski
(74) *Attorney, Agent, or Firm* — Dunlap Bennett & Ludwig PLLC; Brendan E. Squire

(57) ABSTRACT

A toy holding adapter for removably attaching a fidget spinner to an article. The article may include an airplane; a helicopter, or a cycle, such as a motorcycle or a bicycle. The fidget spinner is mounted to the article to provide the article with a visual appearance of a rotating body associated with the article to which it is applied. The holding adapter has a stem extending from a back face that is operatively coupled to a receiver in the article. A central cavity in the front face receives a cylindrical adapter cup that is dimensioned to receive a holding disk of the fidget spinner.

14 Claims, 3 Drawing Sheets

FIDGET SPINNER TOY HOLDING ADAPTER

BACKGROUND OF THE INVENTION

The present invention relates to fidget spinner and, more particularly, to holders for fidget spinners.

The current way of holding and playing with fidget spinners is limited to holding them with two fingers and spinning the device. While enjoyable for entertainment and stress relief, this limits and does not create any additional enjoyment or imagination with the toy.

As can be seen, there is a need for an improved holding apparatus for a fidget spinner.

SUMMARY OF THE INVENTION

In one aspect of the present invention, a holding adapter for operatively coupling a fidget spinner to an article is disclosed. The holding adapter includes a cylindrical disk shaped mount having a central cavity defined in a front surface. A stem extends from a back surface and is configured to be removably coupled to a receiver defined in the article. A cylindrical adapter cup has an interior cavity that is dimensioned for an interference fit with a holding disk of the fidget spinner. An outer diameter of the adapter cup is dimensioned for an interference fit within the central cavity of the cylindrical disk shaped mount.

In some embodiments, the article comprises an airplane shaped body and the receiver is oriented at a propeller point of the airplane shaped body. The stem may be coupled to the receiver and the fidget spinner may be coupled to the cylindrical adapter cup. In other embodiments, the article comprises a helicopter shaped body and the receiver is oriented at a rotor point of the helicopter body. In yet other embodiments, the article comprises a cycle shaped body and the receiver is transversely oriented on a fork of the cycle body. The stem may be coupled to the receiver and a fidget spinner may be coupled to the cylindrical adapter cup.

These and other features, aspects and advantages of the present invention will become better understood with reference to the following drawings, description and claims.

DETAILED DESCRIPTION OF THE INVENTION

Figure 1:
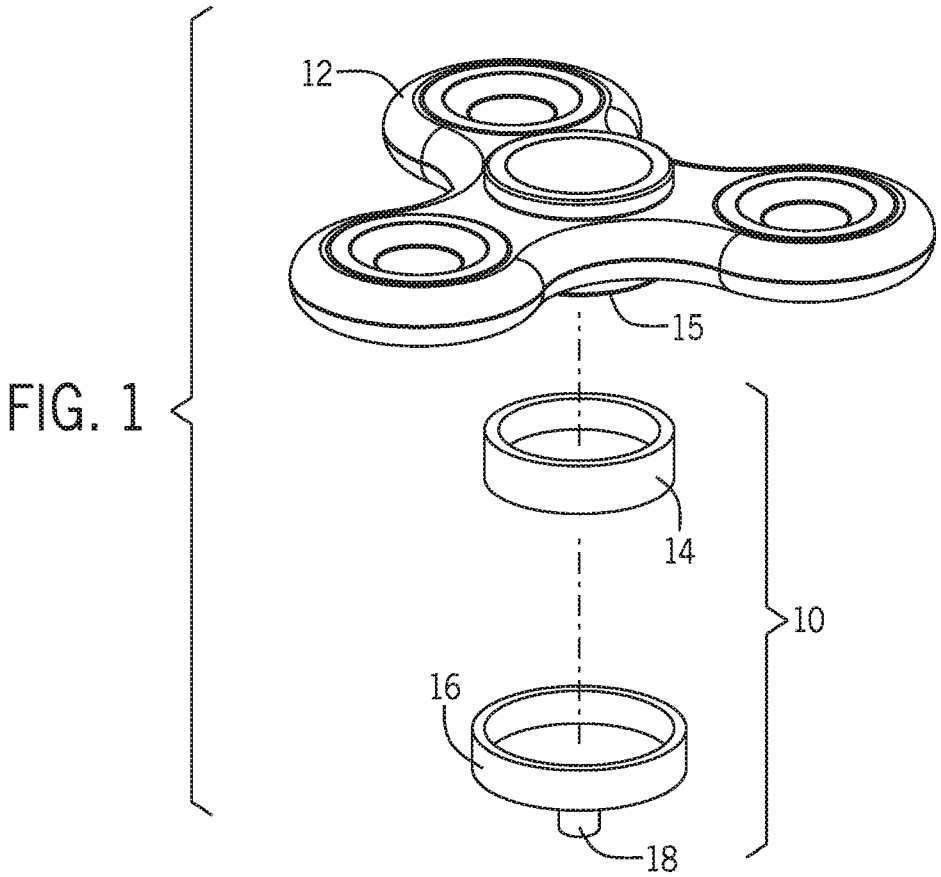
FIG. 1 is an exploded perspective view of the invention.
Figure 2:
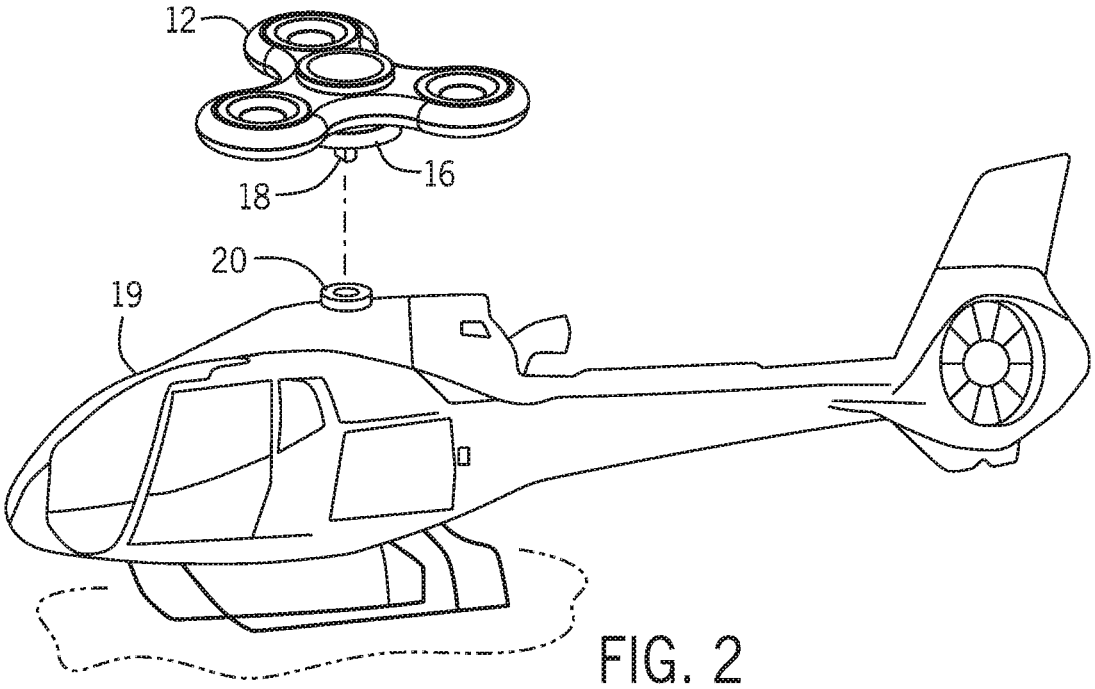
FIG. 2 is an exploded perspective view of the invention with a fidget spinner helicopter.
Figure 3:
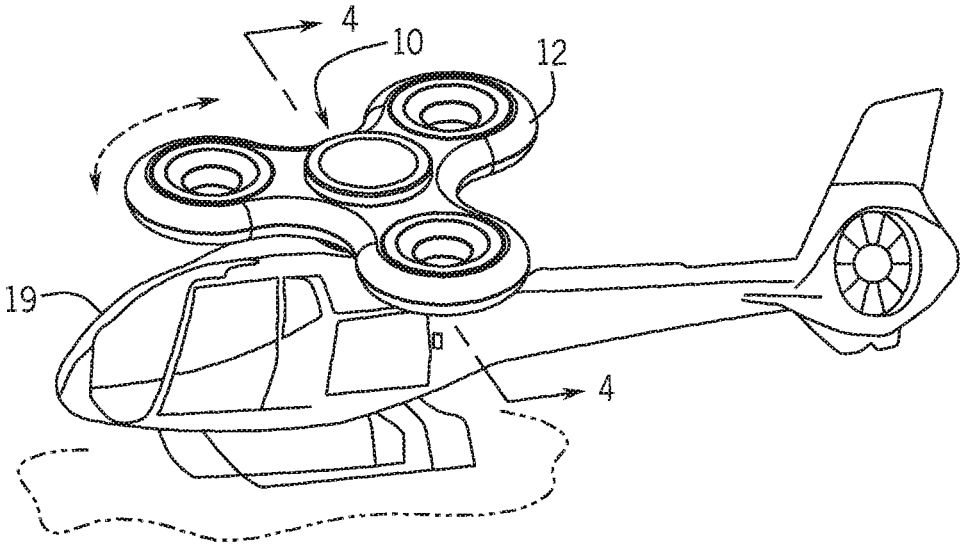
FIG. 3 is a perspective view of the invention in use with a fidget spinner helicopter.
Figure 4:
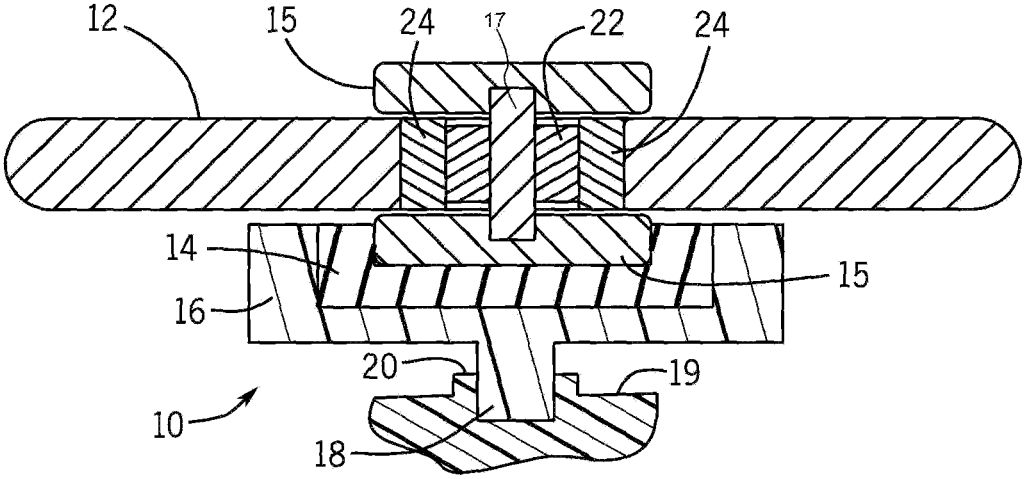
FIG. 4 is a cross-sectional view taken on line 4-4 of FIG. 3.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an improved holding adapter that allows for increased enjoyment of a fidget spinner that allows the fidget spinner to be readily mounted in a fixed position to an article. The article may be a toy helicopter, a plane or a motorcycle wheel, or other article with a spinning accoutrement. The user would no longer have to hold the spinner with two fingers but would allow the invention to sit on a table resembling a toy helicopter with any color or type of spinner to take the place of the propeller. The spinner then creates the illusion of a plane's propeller or helicopter rotor which can replaceable couple with a different fidget spinner at any time.

The holding adapter and an associated article can be used as a toy for children or a fidget device for an adult on the desk of an office. People may receive more enjoyment out of the holding adapter and article than with the fidget spinner alone, and their imagination will be more stimulated, thus having the potential to yield an even greater positive affect on an individual suffering with boredom or ADHD.

As seen in reference to the drawings of FIGS. 1-6, the holding adapter 10 is configured to removably attach to a fidget spinner 12 and selectively mount it to an article. Non-limiting examples of the article may include: a helicopter 19, a bicycle or motorcycle, or an airplane 27 model.

The fidget spinner 12 generally includes a central hub and a plurality of weighted spinner blades. The hub includes a holding disk 15 on each side of the fidget spinner that is carried on a shaft 17 extending through a central axis of the inner bearing race 22. The inner bearing race 22 is carried in an outer bearing race 24 for rotation of the blades about the bearings 22, 24 and the shaft 17. In conventional use, the user holds the spinner with two fingers by pressing the holding disks 15 between their fingers.

The holding adapter 10 includes a cylindrical adapter cup 14 and a cylindrical mount 16. The cylindrical adapter cup 14 has an interior cavity with a diameter dimensioned for an interference fit with the holding disk 15 of the spinner 12. An outer diameter of the cylindrical adapter cup 14 is dimensioned to be received within a central cavity defined in a front face of the cylindrical mount 16 with an interference fit. A stem 18 extends from a back face of the cylindrical mount 16. The stem 18 is configured to be removably coupled to a receiver 20 defined in the body of the article. The cylindrical cup 14 may be formed of a resilient material such as rubber, or other elastomeric material, so that the hub 15 may be received within the cylindrical cup 16 in a press fitting engagement. In some embodiments, the holding disk 15 may be secured within the adapter cup 14 via an adhesive.

When mounted to the article, the holding adapter 10 permits the spinner 12 to provide a spinning adornment to the article. As seen in reference to FIG. 3, the spinner 12 may be attached to an article shaped with a helicopter body 19. The spinner 12 is removably attached to the helicopter body 19 via the holding adapter 10. The spinner 12 may then be rotated about the holding adapter 10 to provide a visual simulation of a rotor system.

Figure 5:
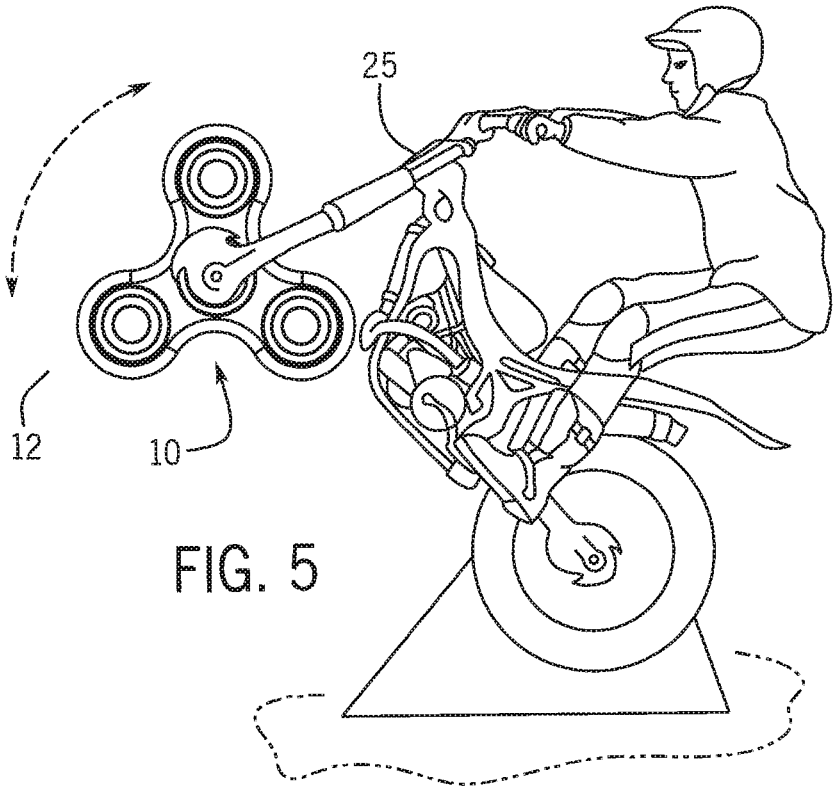
FIG. 5 is a side elevation view of the invention in use with a fidget spinner bike.

In the representative embodiment shown in reference to FIG. 5, one or more holding adapters 10 permit the spinner 12 to be mounted to the article body that is shaped as a motorcycle 25. In the embodiment shown, the spinner 12 may be mounted to a fork of a motorcycle 25. With the spinner 12 mounted to the fork, the spinner 12 may be operated in a spinning motion to provide a visual simulation of a wheel spinning on the motor cycle.

Figure 6:
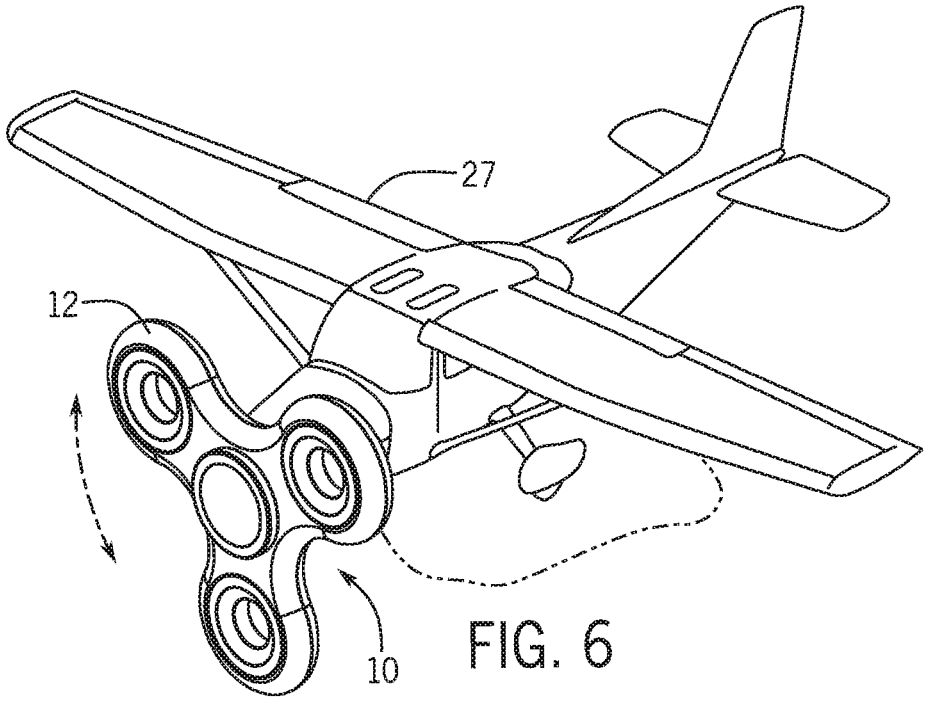
FIG. 6 is a perspective view of the invention in use with a fidget spinner airplane.

In another representative embodiment, shown in reference to FIG. 6, the holding adapter 10 permits the spinner 12 to be mounted to the article body that is shaped as an airplane fuselage and wings 27. The holding adapter 10 may be coupled to the airplane 27 at a receiving point 20 for a propeller based on the style of the airplane body 27. With the spinner 12 mounted to the airplane body 27, 10, the spinner 12 may be operated in a spinning motion to provide a visual simulation of a propeller.

It should be understood, of course, that the foregoing relates to exemplary embodiments of the invention and that modifications may be made without departing from the spirit and scope of the invention as set forth in the following claims.

What is claimed is:

1. A holding adapter for operatively coupling a fidget spinner to an article, comprising:

a cylindrical disk shaped mount having a central cavity defined in a front surface and a stem extending from a back surface, the stem configured to be removably coupled to a receiver defined in the article;

a cylindrical adapter cup has an interior cavity that is dimensioned for a stationary interference fit with a holding disk of the fidget spinner; and an outer diameter that is dimensioned for a stationary interference fit within the central cavity of the cylindrical disk shaped mount.

2. The holding adapter of claim 1, wherein the article comprises an airplane shaped body and the receiver is oriented at a propeller point of the airplane shaped body.

3. The holding adapter of claim 2, wherein the stem is coupled to the receiver.

4. The holding adapter of claim 3, wherein a fidget spinner is coupled to the cylindrical adapter cup.

5. The holding adapter of claim 1, wherein the article comprises one of a helicopter shaped body and the receiver is oriented at a rotor point of the helicopter body.

6. The holding adapter of claim 5, wherein the stem is coupled to the receiver.

7. The holding adapter of claim 6, wherein a fidget spinner is coupled to the cylindrical adapter cup.

8. The holding adapter of claim 1, wherein the article comprises one of a cycle shaped body and the receiver is oriented on a fork of the cycle body.

9. The holding adapter of claim 8, wherein the stem is coupled to the receiver.

10. The holding adapter of claim 9, wherein a fidget spinner is coupled to the cylindrical adapter cup.

11. An accessory to carry a fidget spinner, comprising:

a receiver defined at an axis of rotation of a rotational body associated with a model;

a disk shaped mount having a central cavity defined in a front surface and a stem extending from a back surface, the stem configured to be removably coupled to the receiver defined in the model;

an adapter sleeve having an interior diameter that is dimensioned for a non-rotating interference fit with a holding disk of the fidget spinner, the holding disk carried by an inner bearing race of the fidget spinner; and the adapter sleeve having an outer diameter that is dimensioned for a non-rotating interference fit within the central cavity of the disk shaped mount.

12. The accessory of claim 11, wherein the model comprises one of a helicopter body, a motorcycle body, and an airplane body.

13. The accessory of claim 11, wherein the rotational body associated with the model is one of a rotor, a wheel, and a propeller.

14. The holding adapter of claim 11, wherein the fidget spinner is coupled to the disk shaped mount.

* * * * *